US005189963A

United States Patent [19]

Mann

[11] Patent Number: 5,189,963

[45] Date of Patent: Mar. 2, 1993

[54] COMBUSTIBLE ATMOSPHERE FURNACE CONTROL SYSTEM

[76] Inventor: Carlton B. Mann, 1203 S. Chilton, Tyler, Tex. 75701

[21] Appl. No.: 769,934

[22] Filed: Sep. 30, 1991

[51] Int. Cl.[5] ..... F23N 5/02

[52] U.S. Cl. ..... 110/190; 110/185; 110/229; 110/345; 110/348; 432/24; 432/26

[58] Field of Search ..... 110/190, 185, 348, 346, 110/188, 189, 345, 229; 432/19, 24, 26

[56] References Cited

U.S. PATENT DOCUMENTS

| | | | |
|---|---|---|---|
| 4,827,855 | 5/1989 | Kuptis et al. | 110/190 X |
| 4,986,198 | 1/1991 | Naito et al. | 110/190 X |
| 5,018,458 | 5/1991 | McIntyre et al. | 110/190 X |

*Primary Examiner*—Edward G. Favors

*Attorney, Agent, or Firm*—John F. Bryan, Jr.

[57] ABSTRACT

The operation of a combustible atmosphere furnace is controlled by monitoring the temperature of the combustible atmosphere, and the rate-of-change thereof. The measured rate-of-change is compared to a previously determined safe rate-of-change so as to anticipate and discourage incipient internal ignition.

10 Claims, 2 Drawing Sheets

COMBUSTIBLE ATMOSPHERE FURNACE CONTROL SYSTEM

BACKGROUND OF THE INVENTION

Firing, in various forms has long been used as a means of disposal or removal of unwanted combustible waste. Volumes of smoke may be released if the process is uncontrolled, and environmental concerns have caused limitation and stringent regulation of such activities. However, The Environmental Protection Agency does find ecological profit in using properly controlled burn-off processes to reclaim materials for reuse or recycling, therefore such applications are now encouraged.

An oven, or primary chamber is fired and held at a given control temperature or "set point" by a thermostat. Those skilled in the furnace arts will add an afterburner to the oven. There, smoke and any gaseous components are combined with an excess volume of air in a lean, non-explosive mixture which is burned completely at elevated temperatures before being released into the air. This process differs from incineration in that the combustible materials are pyrolized in a low oxygen atmosphere in the primary chamber and pass to the afterburner as smoke and gases. The primary chamber thus operates at a relatively low temperature, protecting the reclaimable items. In this process there is a real risk of fire or explosion should the mixture/temperature profile exceed the lower explosive limit (LEL).

This process has heretofore been controlled in various ways, for example, as is disclosed by Kelly in U.S. Pat. No. 4,270,898. Kelly teaches the use of an oven water spray activated at a preset (1,700 F.) stack temperature, downstream from the afterburner. Water is sprayed in the primary chamber so that the concentration of combustible gases is reduced to a safe level. Mainord, U.S. Pat. No. 4,557,203, discloses a variation of the Kelly teaching wherein a modulated water spray is used while the primary burners stay on, even at oven control temperature, to better maintain an inert atmosphere. In any case, the operating temperature limit of 1,700 F. taught by Kelly is a severe limitation since elevated temperatures are necessary to achieve environmentally acceptable decomposition and oxidation of discharge gases.

Another control technique is disclosed by Koptis, et al. in U.S. Pat. No. 4,759,298, where he teaches control by adherence to a programmable oven temperature/-time profile which is adapted to the product to be processed and the furnace characteristics. While such a system may allow safe operation, it also requires the operator to anticipate and evaluate all of the variables which enter into the combustion process; oven charge weight, composition, water content, BTU content, etc.

Each of these control systems assumes a constant set of conditions and responds in a rigid manner, where in fact, the conditions that lead to fire or explosion are widely variable. The LEL varies with oven temperature, gaseous mixture components, concentration and heat value, air flow, oven fuel flow and heat loss. As a consequence, performance is routinely compromised in quest of safety, resulting in either time consuming, inefficient operation or the discharge of incompletely processed materials. Even so, fires and explosions have been commonplace.

Accordingly, a first object of the present invention is to control the firing of combustible atmosphere furnaces by sensing and discouraging incipient ignition of the combustible atmosphere so as to avoid fire or explosion.

A second object is to control the firing of combustible atmosphere furnaces in a manner consistent with the elevated temperatures necessary to environmentally acceptable decomposition and oxidation of discharge gases.

A third object is to accomplish safe and effective combustible atmosphere furnace operation independent of operator judgement.

SUMMARY OF THE INVENTION

When combustible materials are vaporized in a furnace so that the gaseous mixture concentration reaches the LEL, explosive ignition inside of the oven or a stack fire is imminent. The inventor noted that internal furnace temperatures increased rapidly in advance of the actual ignition, in relationship to the increasing heat content of the mixture as the LEL is approached.

The process heat of combustion can be expressed as:

$$HC = \frac{\text{Mixture concentration}}{LEL\ \text{concentration}} \times 50\ \text{BTU/Cu Ft}$$

This being an empirically determined value at standard conditions of temperature and pressure.

In the present invention, this rate-of-change of combustible atmosphere temperature becomes the definitive control index. An arbitrary rate may be established as a control limit which will signal for some cooling action to discourage combustion. The action may be burner modulation or a cooling sequence such as water spray or increased air flow, but in any case, will produce a cooler, leaner, non-explosive mixture. Further improvement in control system performance can result if the temperature rate-of-change limit is related to the characteristic "Temperature Rate-of-Change v. Temperature" curve of a given furnace, so that only the true excess component of temperature change rate is considered for purposes of control.

There are no commercially available control devices specifically intended for use as temperature rate-of-change activated switching control but such a device can be readily made and programmed. The dynamics of the marketplace will create such a product in time but, for the present, commercial proportional/integral/-derivative (PID) controls as made by Honeywell, Inc. of Fort Washington, PA and others, can be programmed to approximate the required characteristics.

In actual use, the present invention has been found to provide added advantages over the prior art in that a temperature rate-of-change control can sense the completion of the process and shut down the oven. In this manner, cycle time selection is also an automatic function and the operator can be relieved of even this responsibility.

DESCRIPTION OF THE DRAWINGS

The aforementioned and other objects and features of the invention will be apparent from the following detailed description of specific embodiments thereof, when read in conjunction with the accompanying drawings, in which.

DETAILED DESCRIPTION

Figure 1:
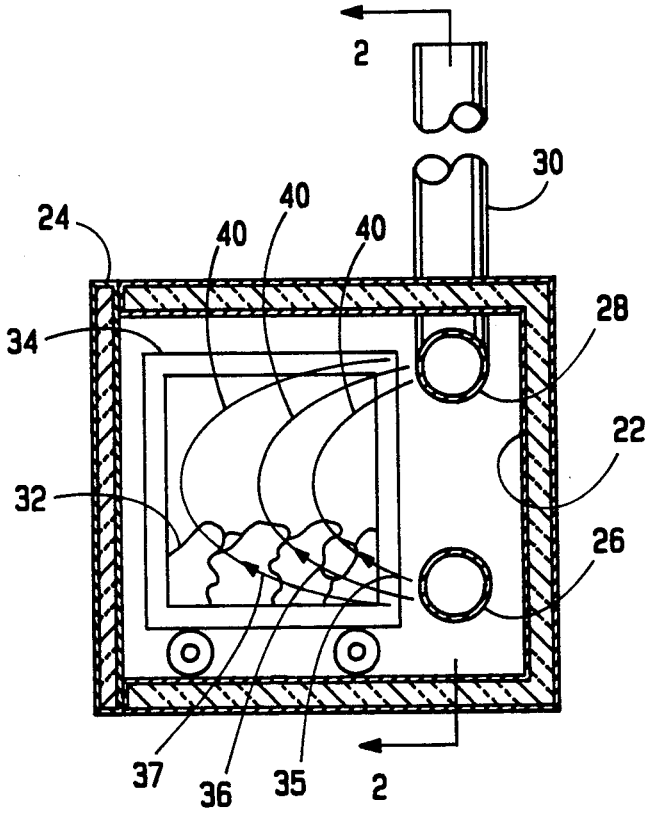
FIG. 1 is a longitudinal section view of a combustible atmosphere furnace showing a typical application thereof.

Referring now to FIG. 1, furnace 20 is shown to comprise oven 22, oven door 24, firing chamber 26, afterburner chamber 28 and stack 30. In this application, contaminated parts 32 are conveniently contained in wheeled cart 34 which facilitates the charging and discharging of furnace 20. Flow paths 35, 36 and 37 indicate the flow of heated gases from firing chamber 26 through parts 21 and into afterburner chamber 28 during operation of furnace 20. As parts 21 are so heated, the contaminates vaporize and become constituents of combustible atmosphere 40.

Figure 2:
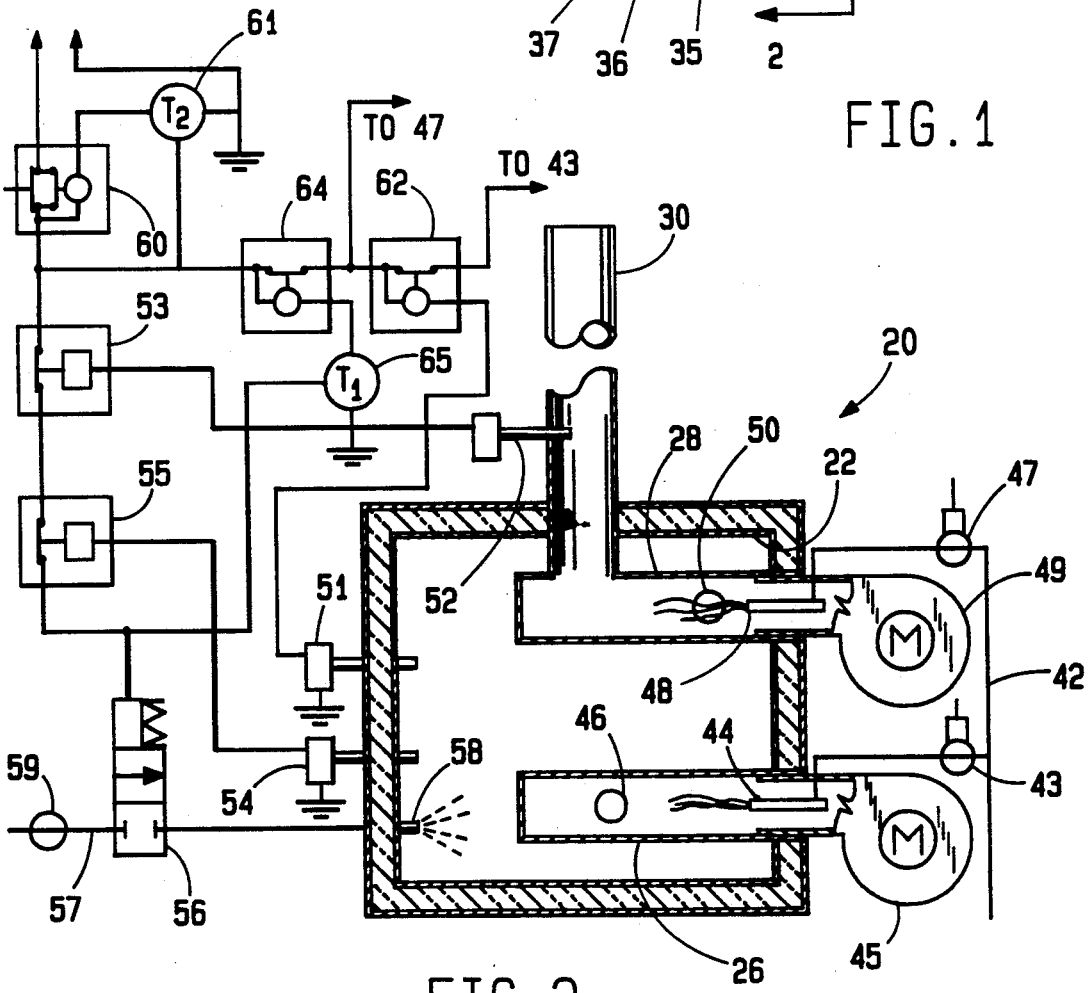
FIG. 2 is a transverse sectional view of the same combustible atmosphere furnace showing an embodiment of the present invention.

In FIG. 2 is shown an embodiment of the present invention as used for the safe control of furnace 20 in a manner which anticipates and avoids ignition or explosion of combustible atmosphere 40. This view is taken from the direction of arrows 2—2 of FIG. 1 and also allows a more complete understanding of the operation of furnace 20. Here, firing chamber 26 is shown to include burner 44, blower fan 45, and outlet 46. Similarly, afterburner chamber 28 includes blower fan 49, burner 48 and inlet 50. Furnace 20 is fired by engaging master switch 60 to open firing chamber burner valve 43 and afterburner chamber burner valve 47. This admits fuel from supply line 42 which is ignited by conventional pilot flames as is well known in the art. The operation of firing chamber burner valve 43 is also monitored by thermostat 51, causing switch 62 to open at a predetermined oven control temperature. This oven control temperature is not critical, but must be set high enough to sustain pyrolysis.

Gaseous flow is maintained along flow paths 35, 36 and 37 by a low pressure in stack 30 as compared to that in oven 22, and by aspiration through inlet 50. An abundance of excess air is supplied by afterburner blower fan 49 to achieve complete oxidation of combustible atmosphere 40 in afterburner chamber 28 and stack 30. Conversely, minimal excess air is supplied by firing chamber blower fan 45 in order to preserve the pyrolytic nature of the oven process.

Stack thermocouple 52 and alternate oven thermocouple 54 measure the temperature of the combustible atmosphere 40 at those locations and send the readings to temperature rate-of-change activated, normally closed switching devices 53 and 55 respectively. The invention can be expressed in embodiments that utilize either or both of these sensing locations. Furnace control accomplished by sensing temperature rate-of-change in the stack 30 is somewhat more responsive for materials that volatilize at temperatures well below their ignition temperature, while sensing in oven 22 is preferred for materials that volatilize at temperatures close to their ignition temperature. In either case, temperature rate-of-change activated switching control devices 53 or 55, which are both normally closed, will open upon reading a rate-of-change in excess of a preset limit. This causes cooling water valve 56 to open, injecting cooling water spray 58 into oven 22. Normally open cooling water valve 56 provides for fail safe control, and water supply valve 59 is closed to prevent leakage through supply line 57 when the furnace is shut off.

Cooling water spray 58 counters the rate of increase of temperature and also slows the enrichment of combustible atmosphere 40 to stabilize the process prior to ignition or explosion. When the temperature rate-of-change falls to an acceptable level, cooling water spray 58 is shut off.

A cycle timer 61 may used to release master switch 60 at a preset maximum cycle duration and a "smart" secondary timer 65, can be also be programmed to close burner valves 43 and 47 for an effective shut down whenever there has not been a water spray 58 for a given period of time, usually about 10 minutes.

There are no commercially available control devices specifically intended for use as a temperature rate-of-change activated switching control, but such a device can be readily made and programmed. The dynamics of the marketplace will create such a product in time but, for the present, commercial Proportional/Integral/-Derivative (PID) controls sold by Honeywell, Inc. of Fort Washington, PA and others, can be programmed to approximate the required characteristics.

The control manufacturer's intention for the "derivative" function in their PID controls is to sense response rates, so as to avoid overshoot of "proportional" control input functions. Derivative functions are used only during a small portion of total operating time, since otherwise they tend to destabilize proportional control functions. Fortunately, for the purposes of the present invention, when the "proportional" function of a PID control is effectively disabled, as by a minimal 0.1% setting, the "derivative" function is tricked into acting as a virtual "rate-of-change" control.

Figure 3:
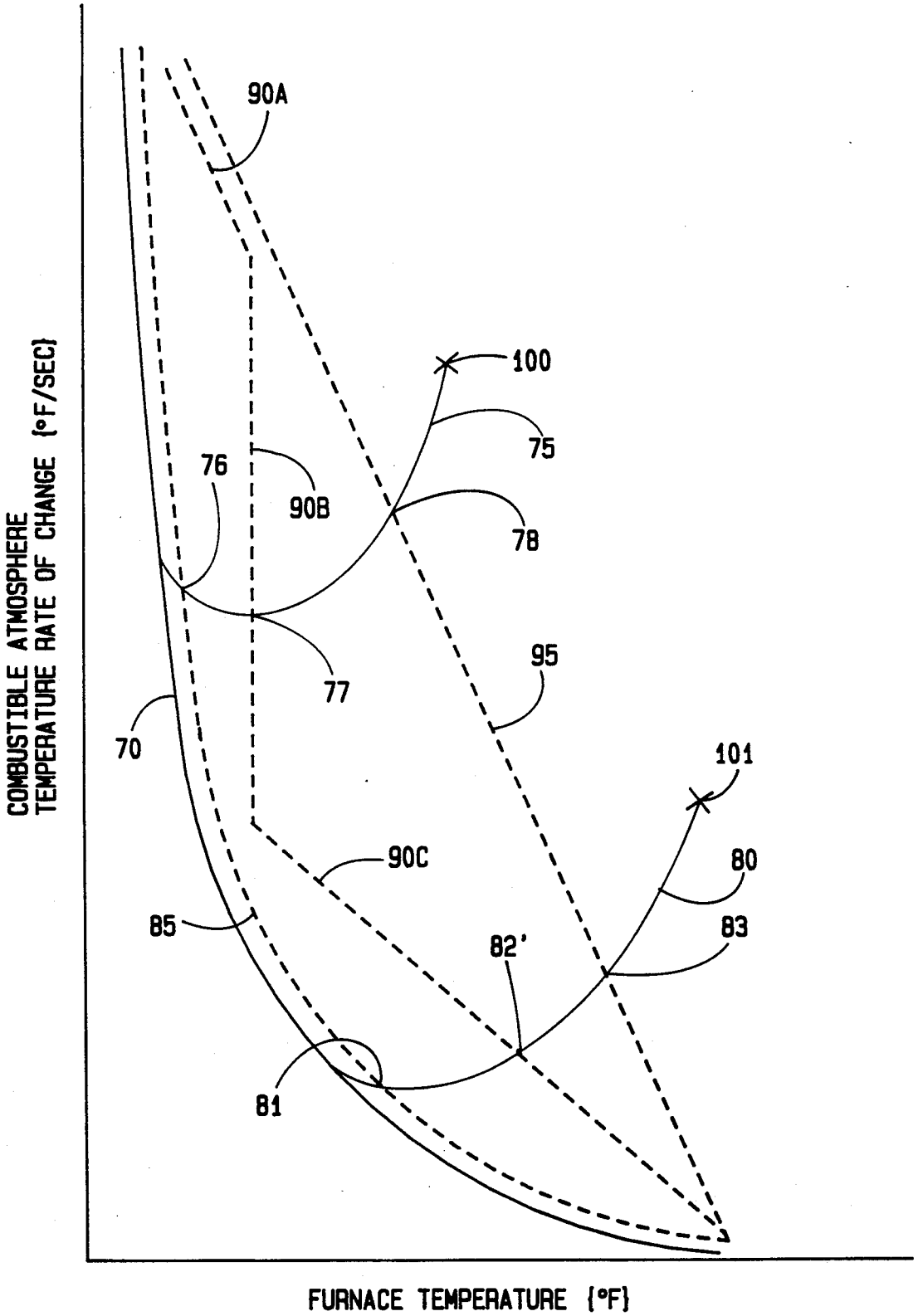
FIG. 3 is a graphic presentation of the principles of the present invention.

FIG. 3 displays furnace temperature and control relationships in graphic terms as plots of TEMPERATURE RATE-OF-CHANGE v. TEMPERATURE rather than the prior art terms of TEMPERATURE vs. ELAPSED TIME so that control is unrelated to elapsed time. Curve 70 shows this continuous relationship for furnace 20 as it is heated up from ambient temperature with a non-volatile charge. The affect of volatile constituents is seen in curves 75 and 80 which show how the rate-of-change of temperature might be increased by the process heat of combustion of a richening volatile mixture in either oven 22 or stack 30. If the volatile events represented by either curve 75 or 80 is allowed to go to completion, the temperature rate-of-change will increase as shown to ignition point 100 or 101.

Curve 85 represents an idealized continuous rate-of-change limit, which would signal for cooling water spray 58 at the conditions of intersections 76 and 81. Curve 90 represents a preferred practical approximation of curve 85 as primary and secondary rate segments 90A and 90C with a constant temperature transition segment 90B comprise a continuous temperature rate-of-change control limit. Curve 90 may be programmed with available dual rate PID controllers such as the Honeywell Model UDC 3000. Here, the signal for cooling water spray 58 is seen to occur at intersections 77 and 82. A workable solution, albeit one which provides somewhat coarser control than is less suited to highly volatile materials, can be achieved with a single rate PID controller as is shown by curve 95. Here, the signal for cooling water spray 58 is seen to occur at intersections 78 and 83.

From the foregoing, it is clear that the present invention may be expressed in various combinations and functionally equivalent embodiments. It is to be understood that the invention is not limited to the disclosed embodiments and is capable of modification or substitution of parts or elements without departing from the spirit of the invention.

I claim:

1. A method for temperature control of a combustible atmosphere processing furnace independent of elapsed time without internal ignition or explosion comprising:

establishing a safe upper limit for the rate-of-change of combustible atmosphere temperature with respect to the temperature thereof for said furnace;

charging said furnace with volatile materials;

firing said furnace;

continuously measuring the temperature of the combustible atmosphere of said furnace;

continuously determining the rate-of-change of said combustible atmosphere temperature with respect to the temperature thereof;

cooling said furnace whenever said combustible atmosphere temperature rate-of-change with respect to the temperature thereof exceeds said established safe limit; and discontinuing said cooling when said combustible atmosphere temperature rate-of-change with respect to the temperature thereof is less than said established safe limit.

2. A method for control of temperature within the operating temperature range of a combustible atmosphere processing furnace without internal ignition or explosion comprising:

determining the characteristic curve relationship of the rate-of-change of furnace atmosphere temperature with respect to the temperature thereof when said furnace is fired in a non-volatile condition;

establishing a curve relationship for a rate-of-change of temperature of said combustible atmosphere with respect to the temperature thereof at a higher temperature level than said characteristic curve so as to define a safe limit for rate of temperature increase for all temperatures within said operating range;

charging said furnace with volatile materials;

re-firing said furnace;

continuously measuring the temperature of the combustible atmosphere of said furnace;

continuously determining the rate-of-change of said combustible atmosphere temperature with respect to the temperature thereof;

cooling said furnace whenever said rate-of-change of combustible atmosphere temperature exceeds said established safe linit; and discontinuing said cooling when said rate-of-change of combustible atmosphere temperature is less than said established safe limit.

3. A method for control of volatile mixture concentration of a combustible atmosphere processing furnace independent of elapsed time without internal ignition or explosion comprising:

establishing a safe upper limit for the rate-of-change of combustible atmosphere temperature with respect to the temperature thereof for said furnace;

charging said furnace with volatile materials;

firing said furnace so as to gasify said volatile materials;

continuously measuring the temperature of the combustible atmosphere of said furnace;

continuously determining the rate-of-change of said combustible atmosphere temperature with respect to the temperature thereof; and decreasing the concentration of said volatile mixture whenever said combustible atmosphere temperature rate-of-change exceeds said established safe limit.

4. A method for control of volatile mixture concentration within the operating temperature range of a combustible atmosphere processing furnace without internal ignition or explosion comprising:

determining the characteristic curve relationship of the rate-of-change of furnace atmosphere temperature with respect to the temperature thereof when said furnace is fired in a non-volatile condition;

establishing a curve relationship for a rate-of-change of temperature of said combustible atmosphere with respect to the temperature thereof at a higher temperature level than said characteristic curve so as to define a safe limit for rate of temperature increase for all temperatures within said operating range;

charging said furnace with volatile materials;

re-firing said furnace;

continuously measuring the temperature of the combustible atmosphere of said furnace;

continuously determining the rate-of-change of said combustible atmosphere temperature with respect to the temperature thereof;

decreasing the concentration of said volatile mixture by cooling said furnace when said rate-of-change of combustible atmosphere temperature exceeds said established safe limit; and discontinuing said cooling whenever said rate-of-change is less than said established safe limit.

5. A combustible atmosphere processing furnace comprising:

an oven chamber for containing combustible materials;

means for firing said oven chamber so as to pyrolize said combustible materials;

means for combustion of gaseous constituents released by said pyrolysis;

means for establishing a safe limit for temperature rate-of-change with respect to temperature thereof for the combustion of said gaseous constituents;

means for continuously measuring the temperature of said combustion;

means for continuously determining the instant rate-of-change of said temperature with respect to the temperature thereof;

means for cooling said gaseous constituents so as to discourage combustion thereof;

means for activation of said cooling means whenever said instant temperature rate-of-change exceeds said safe limit; and means for deactivation of said cooling means when said instant temperature rate-of-change is less than said safe limit.

6. A combustible atmosphere processing furnace comprising:

an oven chamber for containing combustible materials;

means for firing said oven chamber so as to pyrolize said combustible materials;

means for combustion of gaseous constituents released by said pyrolysis;

means for continuously measuring the temperature of said combustion;

means for continuously determining the instant rate-of-change of said temperature with respect to the temperature thereof;

means for determining a safe limit for said rate-of-change of said temperature at said temperature;

means for comparing said instant rate-of-change to said safe limit;

means for reducing the concentration of said gaseous constituents so as to discourage combustion thereof; and means for activation of said concentration reducing means whenever said instant temperature rate-of-change exceeds said safe limit.

7. A combustible atmosphere processing furnace in accordance with claim 6 wherein:

said temperature measuring means comprises a thermocouple located in said oven chamber.

8. A combustible atmosphere processing furnace in accordance with claim 6 wherein:

said means for combustion of gaseous constituents comprises an afterburner chamber having a discharge stack; and said temperature measuring means comprises a thermocouple located in said stack.

9. A combustible atmosphere processing furnace in accordance with claim 5 wherein:

said temperature measuring means comprises a thermocouple located in said oven chamber.

10. A combustible atmosphere processing furnace in accordance with claim 5 wherein:

said means for combustion of gaseous constituents comprises an afterburner chamber having a discharge stack; and said temperature measuring means comprises a thermocouple located in said stack.

* * * * *